US006296312B1

(12) United States Patent
Congleton et al.

(10) Patent No.: US 6,296,312 B1
(45) **Date of Patent: *Oct. 2, 2001**

(54) ARMREST ASSEMBLY

(75) Inventors: Jerome J. Congleton; Rebecca Congleton Boenigk; Bobby A. Boenigk; Mark E. Benden, all of College Station, TX (US)

(73) Assignee: Neutral Posture Ergonomics, Inc., Bryan, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/654,746

(22) Filed: May 29, 1996

Related U.S. Application Data

(63) Continuation-in-part of application No. 08/391,569, filed on Feb. 21, 1995, now abandoned.

(51) Int. Cl.[7] ..... A47C 7/54

(52) U.S. Cl. ..... 297/411.35; 297/411.36

(58) Field of Search ..... 297/411.35, 411.36, 297/411.37, 411.38, 411.27; 403/96, 93

(56) References Cited

U.S. PATENT DOCUMENTS

| | | | | |
|---|---|---|---|---|
| 1,407,174 | * | 2/1922 | Simpson | 297/411.38 X |
| 3,045,271 | | 7/1962 | Cinotti . | |
| 3,397,312 | * | 8/1968 | Bush | 297/411.35 X |
| 3,397,912 | | 8/1968 | Bush . | |
| 4,235,471 | * | 11/1980 | Tengler | 297/364 |
| 4,277,102 | * | 7/1981 | Aaras et al. | 297/411.36 |
| 4,332,499 | * | 6/1982 | Stucheli | 403/96 X |
| 4,807,935 | * | 2/1989 | King | 297/411.38 |
| 4,917,343 | * | 4/1990 | Wainscott | 403/97 X |
| 4,993,862 | | 2/1991 | Pelta . | |
| 5,143,422 | * | 9/1992 | Althofer et al. | 297/411.36 |
| 5,301,570 | * | 4/1994 | Li | 403/93 X |
| 5,368,365 | * | 11/1994 | Feldberg | 297/411.36 |
| 5,407,249 | * | 4/1995 | Bonutti | 297/411.38 X |
| 5,484,187 | * | 1/1996 | Doerner et al. | 297/411.36 X |
| 5,564,852 | * | 10/1996 | Maxwell et al. | 403/97 |
| 5,599,067 | * | 2/1997 | Schuelke et al. | 297/411.35 |
| 5,647,638 | * | 7/1997 | Ritt et al. | 297/411.36 |
| 5,655,814 | * | 8/1997 | Gibbs | 297/411.35 X |
| 5,749,628 | * | 5/1998 | Synder et al. | 297/411.36 |
| 5,752,683 | * | 5/1998 | Novis et al. | 297/411.36 X |

FOREIGN PATENT DOCUMENTS

| | | | | |
|---|---|---|---|---|
| 7630291 | | 11/1992 | (AU) . | |
| 636223 | * | 11/1992 | (AU) | 297/411.36 |
| 4317610 | * | 12/1994 | (DE) | 297/411.36 |
| 1443952 | * | 7/1976 | (GB) | 297/411.38 |

* cited by examiner

*Primary Examiner*—Peter R. Brown
*Assistant Examiner*—Stephen Vu
(74) *Attorney, Agent, or Firm*—Howrey Simon Arnold & White, LLP

(57) ABSTRACT

A multi-position armrest designed for use with a conventional chair to enhance the comfort of an individual seated within the chair. The armrest includes a support arm having a first end adapted for attachment to a chair and a second end coupled to an arm pad in a manner permitting the arm pad to selectively rotate relative to the support arm. The arm pad includes a first circular locking member engaging a second circular locking member on the support arm to selectively lock the arm pad relative to the support arm. The armrest is also provided with a resilient coupling assembly coupling the arm pad to the support arm in a manner permitting the arm pad to move from the support arm to disengage the first circular locking member from the second circular locking member and permit the arm pad to rotate relative to the support arm.

24 Claims, 5 Drawing Sheets

ARMREST ASSEMBLY

This is a continuation-in-part of U.S. patent application Ser. No. 08/391,569, filed Feb. 21, 1995, which has now been abandoned on Oct. 23, 1996.

BACKGROUND OF THE INVENTION

1. Field of the Invention

The present invention relates to chair armrests. More particularly, the present invention relates to chair armrest assemblies which are adjustable to accommodate the physical characteristics of a variety of users.

2. Description of the Prior Art

Many armrests provided in today's chairs include structures permitting an individual to adjust the position of the armrest relative to the seat of the chair. When an armrest is properly positioned, the comfort of the individual is enhanced. It is also likely that a properly positioned armrest will aid the individual's long term physical well being, since an individual seated in a comfortable chair is more likely to sit with proper posture.

Many prior adjustable armrests are limited in their range of adjustments. For example, U.S. Pat. No. 3,474,993, to Murcott, discloses an arm support which is vertically adjustable by means of a series of vertically spaced apertures. The apertures cooperate with a pin member formed on the bottom of the arm itself. U.S. Pat. No. 5,143,422, to Althofer et al., discloses an arm support for a keyboard. The support is vertically and laterally adjustable. The support also pivots horizontally and vertically using a hinge and spring arrangement. U.S. Pat. No. 4,674,790, to Johnson, discloses a pivotable armrest which may be set at a variety of preselected heights. U.S. Pat. No. 4,069,995, to Miller, provides adjustment through the use of cable members which are laterally deflectable. U.S. Pat. No. 4,277,102, to Aaras, discloses an armrest which is vertically and angularly adjustable. U.S. Pat. No. 4,815,688, to Wood, discloses an armrest which is adjustable vertically and laterally. U.S. Pat. No. 4,828,323, to Brodersen, discloses a self-adjusting armrest which is adjustable in height and slope by means of a ratchet and pawl.

The adjustment structures utilized by these armrests are generally cumbersome. They require the user to manipulate the armrest in an inconvenient manner when a user wishes to adjust the orientation of the armrest. Consequently, individuals are often forced to sit in uncomfortable positions because they forego the complicated adjustment structures provided by the prior art armrests. Worse yet, the uncomfortable positions in which these individuals are forced to sit may cause long term physical problems, requiring therapy, medication, and surgery.

In view of the armrest assemblies provided by the prior art, a need continues to exist for an armrest assembly which may be reoriented in a variety of directions, while also providing a user with a convenient manner in which to reorient the armrest. The present invention provides such an armrest.

SUMMARY OF THE INVENTION

It is, therefore, an object of the present invention to provide a multi-position armrest designed for use with a conventional chair to enhance the comfort of an individual seated within the chair. The armrest includes a support arm having a first end adapted for attachment to a chair and a second end coupled to an arm pad in a manner permitting the arm pad to selectively rotate relative to the support arm. The arm pad includes a first circular locking member engaging a second circular locking member on the support arm to selectively lock the arm pad relative to the support arm. The armrest is also provided with a resilient coupling assembly coupling the arm pad to the support arm in a manner permitting the arm pad to move from the support arm to disengage the first circular locking member from the second circular locking member and permit the arm pad to rotate relative to the support arm.

It is also an object of the present invention to provide an armrest including means for adjusting the linear length of the support arm.

It is another object of the present invention to provide an armrest including means for adjusting the distance between the support arm and the seat to vary the width of the chair.

It is a further object of the present invention to provide an armrest wherein the first circular locking member is an outwardly projecting member and the second circular locking member is a concave member shaped to receive the first circular locking member.

It is also an object of the present invention to provide an armrest wherein the first circular member includes a first set of teeth and the second circular locking member includes a second set of teeth shaped to receive the first set of teeth to lock the arm pad in position relative to the support arm.

It is a further object of the present invention to provide an armrest wherein the first set of teeth and the second set of teeth are substantially square-shaped.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
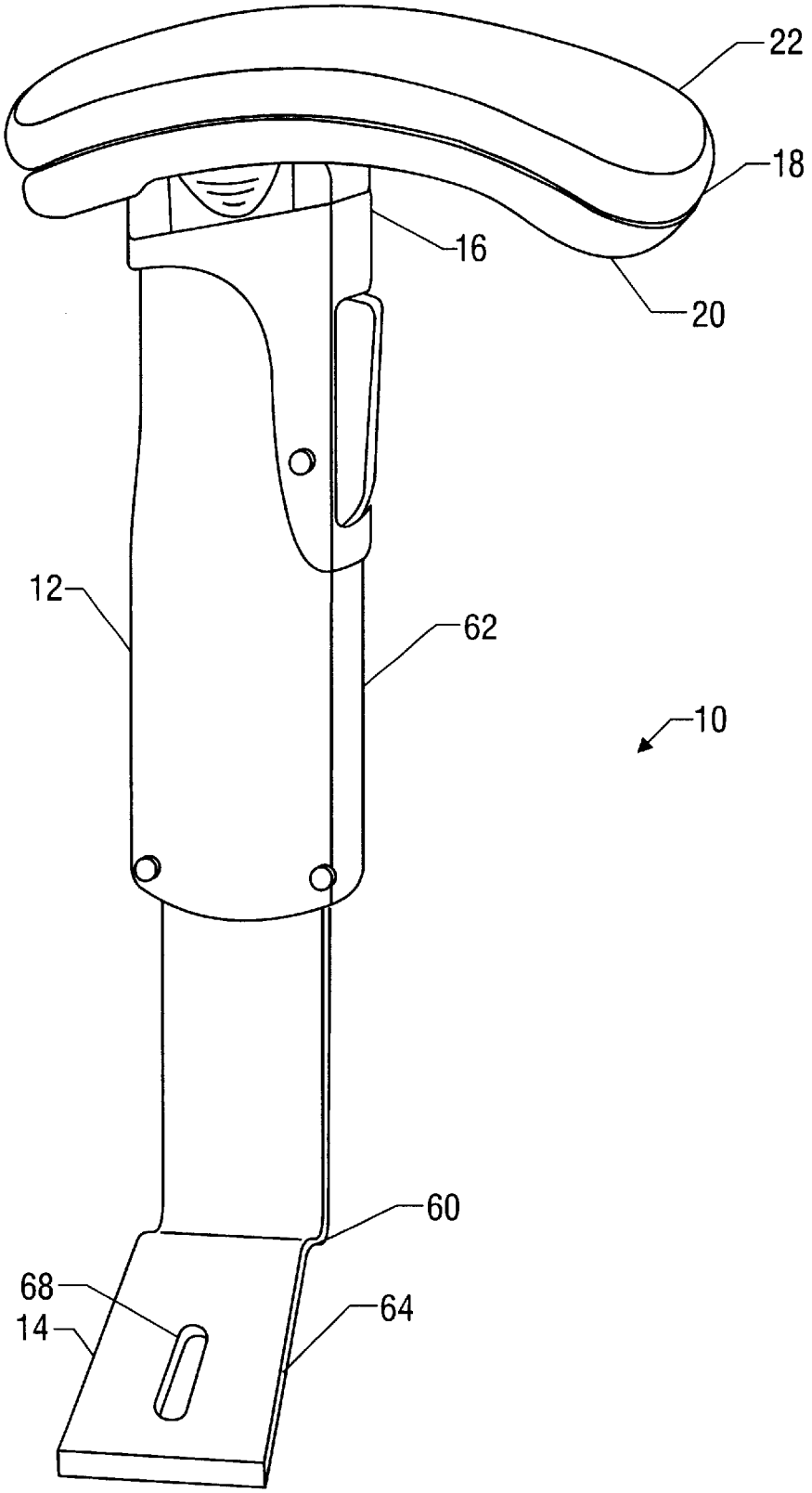
FIG. 1 is a perspective view of the armrest with the arm pad in its lower position.
Figure 2:
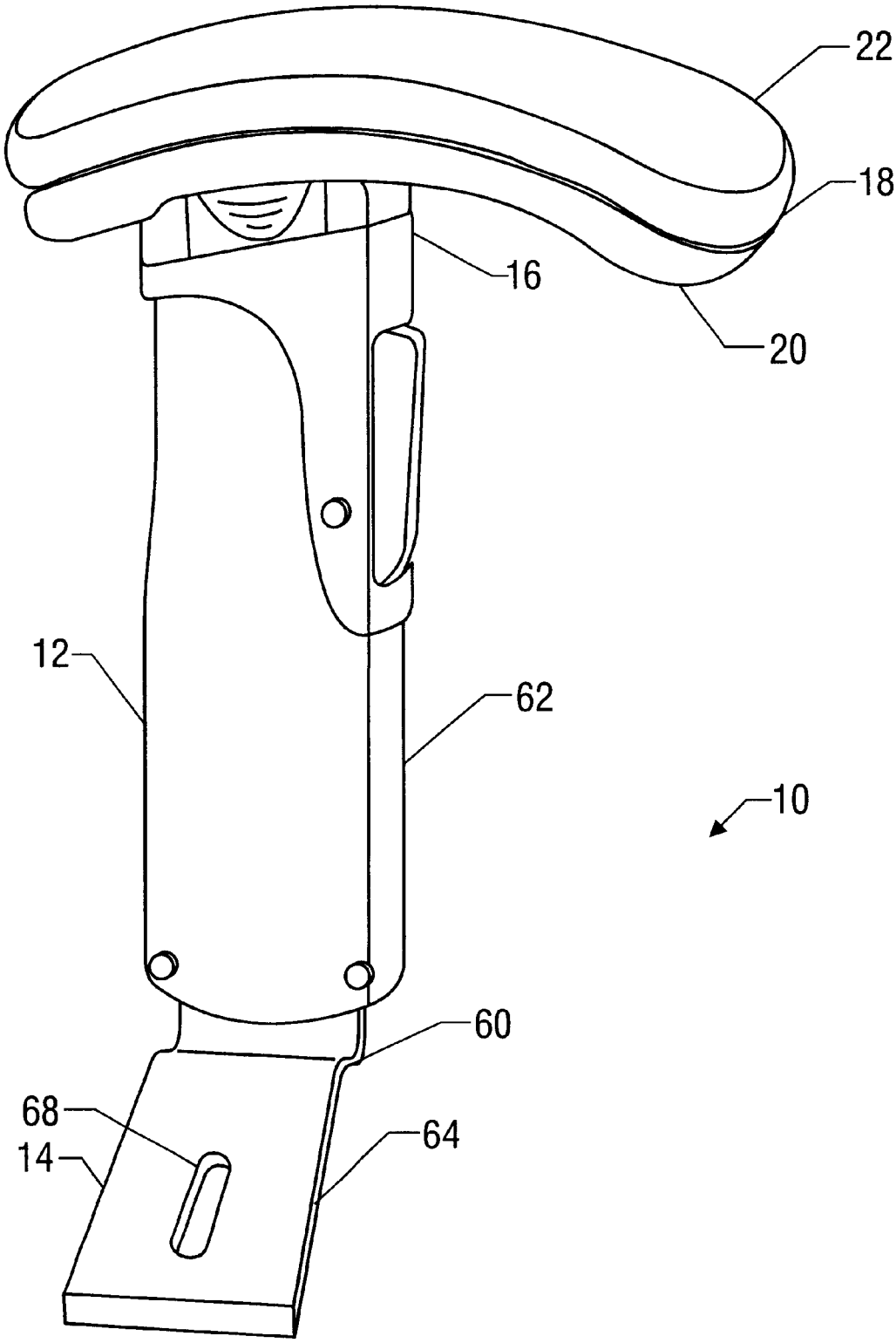
FIG. 2 is a perspective view of the armrest with the arm pad elevated.

With reference to FIGS. 1 and 2, a multi-position armrest 10 is disclosed. The armrest 10 is designed for use with a conventional chair to enhance the comfort of an individual seated within the chair. As such, the armrest 10 permits an individual to adjust the armrest to vary the rotational orientation of the armrest 10, the height of the armrest 10 relative to the seat of the chair, and the distance between the armrest 10 and the seat to vary the width of the chair. The provision of an armrest 10 permitting multiple variations in the orientation of the armrest 10 enhances the comfort of the user as he or she is seated within the chair.

The armrest 10 includes a support arm 12 having a first end 14 adapted for attachment to a chair and a second end 16 coupled to an arm pad 18 in a manner permitting the arm pad 18 to selectively rotate relative to the support arm 12. The arm pad 18 includes a longitudinal support surface 20 having a cushioning member 22 secured on the upper surface thereof. The cushioning member 22 enhances the comfort of the user. The support surface 20 is preferably manufactured from plastic and the cushioning member is preferably a foam.

Figure 3:
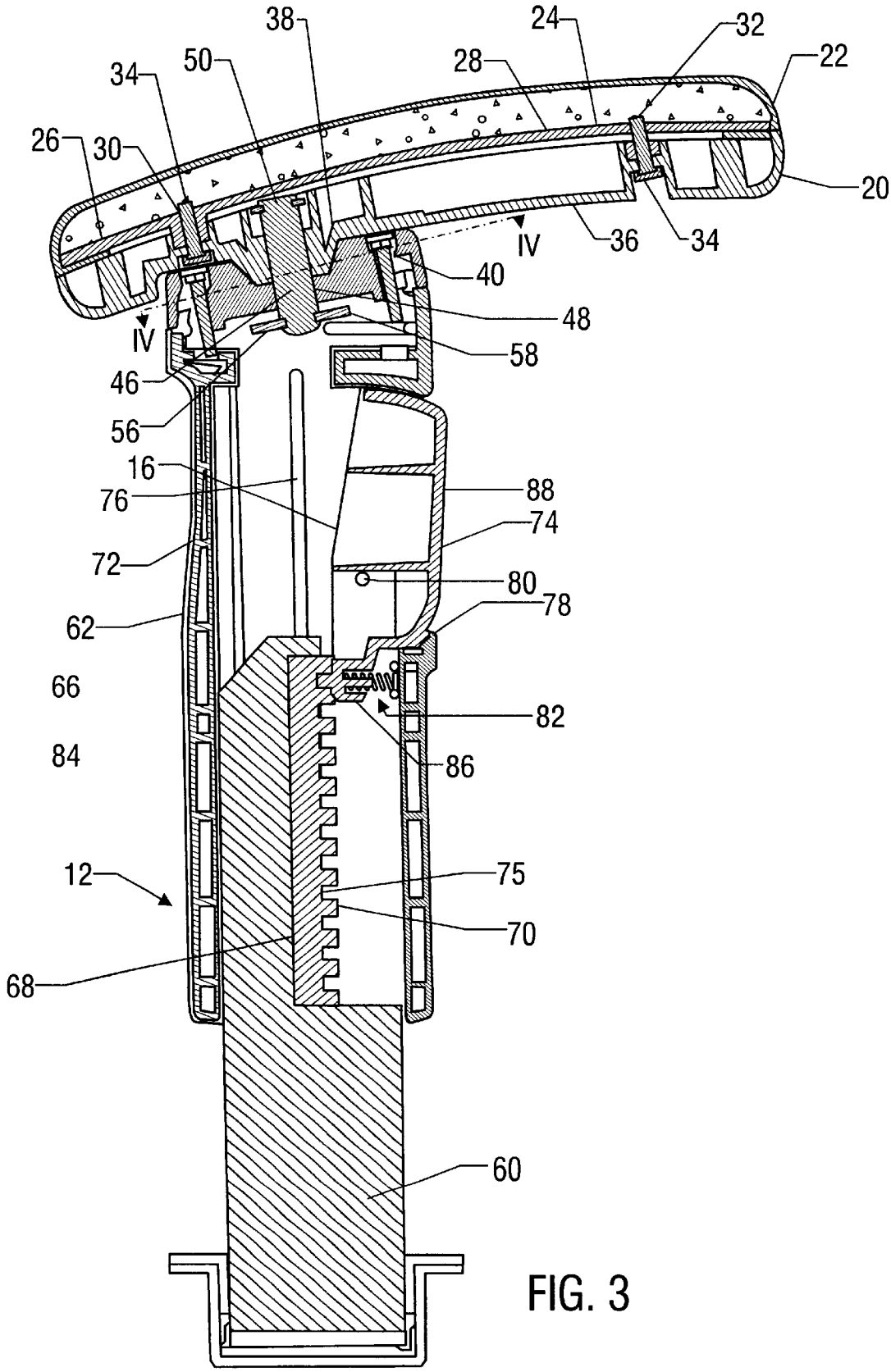
FIG. 3 is a cross-sectional view of the armrest.

Referring to FIG. 3, a first plate 24 and a second plate 26 are coupled to the bottom surface 28 of the cushioning member 22. The first plate 26 and the second plate include threaded openings 30, 32 permitting the cushioning member 22 to be secured to the support surface 20 by a pair of bolts 34.

The support surface 20 includes a bottom surface 36. The bottom surface 36 is provided with a frustoconically shaped first locking member 38 extending therefrom. The first locking member 38 engages a frustoconically shaped second locking member 40 on the second end 16 of the support arm 12. Specifically, the second locking member 40 is a concave surface shaped to receive the first locking member 38. With this in mind, the first locking member 38 can be considered a male member which fits within the female second locking member 40.

Figure 4:
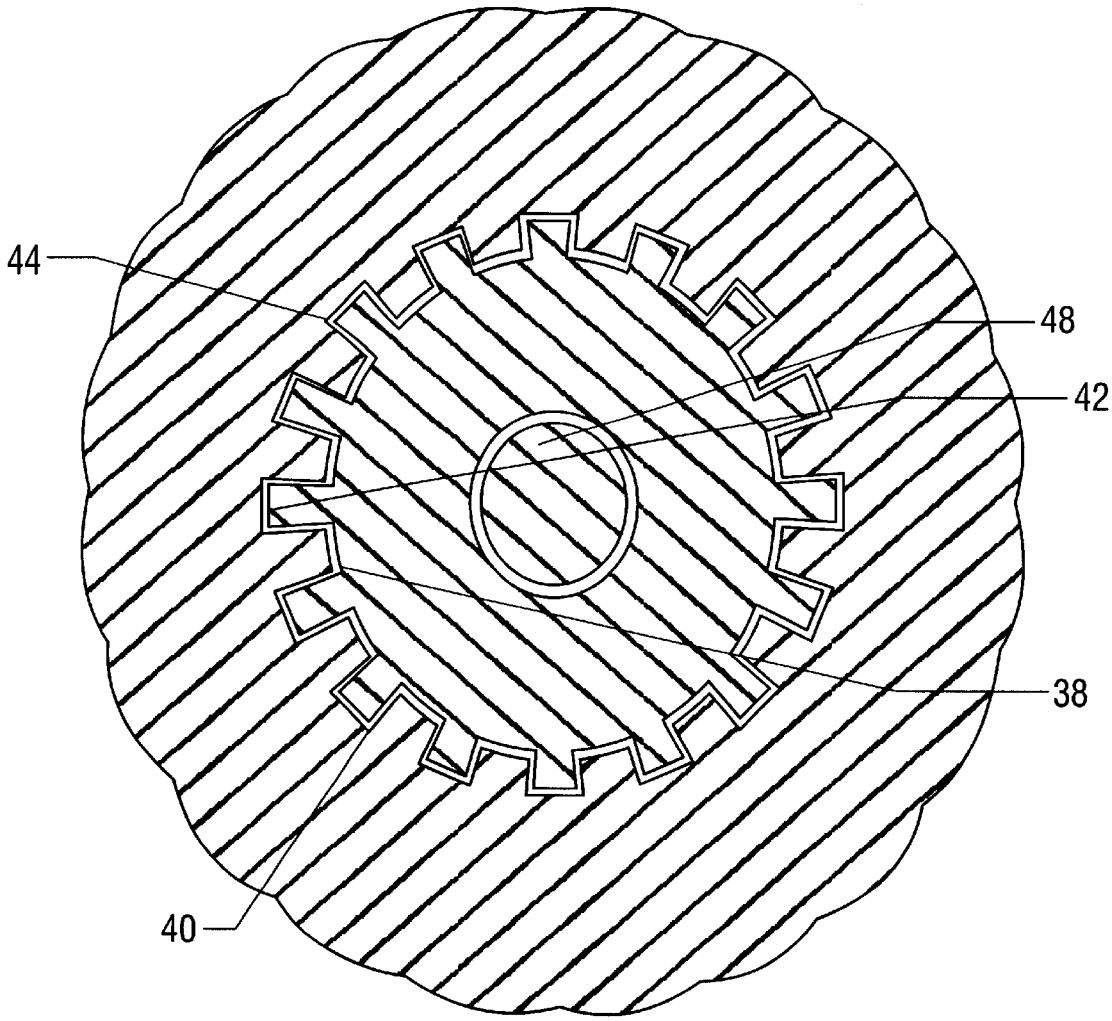
FIG. 4 is a cross-sectional view of the armrest along the section IV—IV of FIG. 3, showing engagement of the first and second locking members.

The first locking member 38 and the second locking member 40 are provided with locking elements 42, 44 (see FIG. 4) preventing the arm pad 18 from rotating relative to the support arm 12 when the locking elements 42 of the first locking member 38 engage the locking elements 44 of the second locking member 40. Specifically, the locking elements 42 on the first locking member 38 are square-shaped teeth projecting outwardly on the first locking member 38 and the locking elements 44 on the second locking member 40 are similarly shaped square-shaped teeth projecting inwardly on the second locking member 40. Other teeth shapes may, however, be used within the spirit of the invention.

A coupling assembly 46 couples the arm pad 18 to the support arm 12 in a manner permitting the arm pad 18 to move from the support arm 12 to disengage the first locking member 38 from the second locking member 40. When the first locking member 38 is disengaged from the second locking member 40, the first set of teeth (i.e., the locking elements 42) move from the second set of teeth (i.e., locking elements 44) to permit the arm pad 18 to rotate relative to the support arm 12.

With reference to FIG. 3, the coupling assembly 46 includes a pin 48 secured between the arm pad 18 and the support arm 12. The first end 50 of the pin 48 is coupled to the support member 20 of the arm pad 18 and the second end 52 of the pin 48 is coupled to the support arm 12. Specifically, the second end 52 of the pin 48 includes a circumferential groove 54 supporting a retaining member 56. The retaining member 56 includes outwardly extending edges 58 which are secured within the second end 16 of the support arm 12.

The coupling assembly 46 permits a user to pull the arm pad 18 from the second end 16 of the support arm 12 to disengage the first locking member 38 from the second locking member 40. As the user pulls upwardly on the arm pad 18, the arm pad 18 moves away from the support arm 12 until the pin 48 prevents further movement of the arm pad 18. Upward movement of the arm pad 18 and the first locking member 38 causes the first locking member 38 to move from the second end 16 of the support arm 12 and the second locking member 40. When the first locking member 38 is disengaged from the second locking member 40, the arm pad 18 is permitted to rotate relative to the second end 16 of the support arm 12.

As mentioned above, the armrest 10 provides an individual with the opportunity to vary the linear length of the support arm 12. This is achieved by the provision of a support arm 12 including an L-shaped arm 60 over which a sleeve 62 is telescopically positioned. The L-shaped arm 60 includes a first end 64 shaped for attachment to the chair in a manner that will be discussed below in greater detail. The second end 66 of the L-shaped arm 60 includes a recess 68 in which a linear row of teeth 70 are positioned.

The sleeve 62 is positioned over the second end 66 of the L-shaped arm 60. The sleeve 62 is shaped with an open inner surface 72 slightly larger than the outer surface of the second end 66 of the L-shaped arm 60. This permits the sleeve 62 to telescopically receive the second end 66 of the L-shaped arm 60 such that the sleeve 62 may freely move upwardly and downwardly on the second end 66 of the L-shaped arm 60 (when the latch member 74 is disengaged from notches 75 formed by the teeth 70). As such, an individual may adjust the linear length of the support arm 12 to accommodate his or her size.

Movement of the sleeve 62 on the second end 66 of the L-shaped arm 60 is controlled by the provision of a guide slot 76 on the inner surface 72 of the sleeve 62. The guide slot 76 cooperates with a pin (not shown) on the surface of the second end 66 of the L-shaped arm 60 to control and limit the telescopic movement of the sleeve 62 on the second end 66 of the L-shaped arm 60.

A latch member 74 pivotally mounted on the sleeve 62 controls adjustment of the sleeve 62 on the second end 66 of the L-shaped arm 60 by releasably securing the sleeve 62 at various locations on the second end 66 of the L-shaped arm 60. The latch member 74 is pivotally mounted within an opening 78 in the wall of the sleeve 62. A pin 80 pivotally mounts the latch member 74 within the opening 78. A spring 82 biases the latch member 74 for engagement with the notches 75 formed in the teeth 70 on the second end 66 of the L-shaped arm 60. Specifically, the latch member 74 includes a projection 84 at its first end 86 . The projection 84 is shaped to fit within the notches 75 created in the teeth 70 on the second end 66 of the L-shaped arm 60. When an individual wishes to move the sleeve 62 along the second end 66 of the L-shaped arm 60, the second end 88 of the latch member 74 is pressed inwardly, causing the projection 84 to pivot away from a notch 75 created by the teeth 70 of the L-shaped arm 60. When the projection 84 is disengaged from the notch 75, the sleeve 12 is free to telescopically move on the second end 66 of the L-shaped arm 60.

Figure 5:
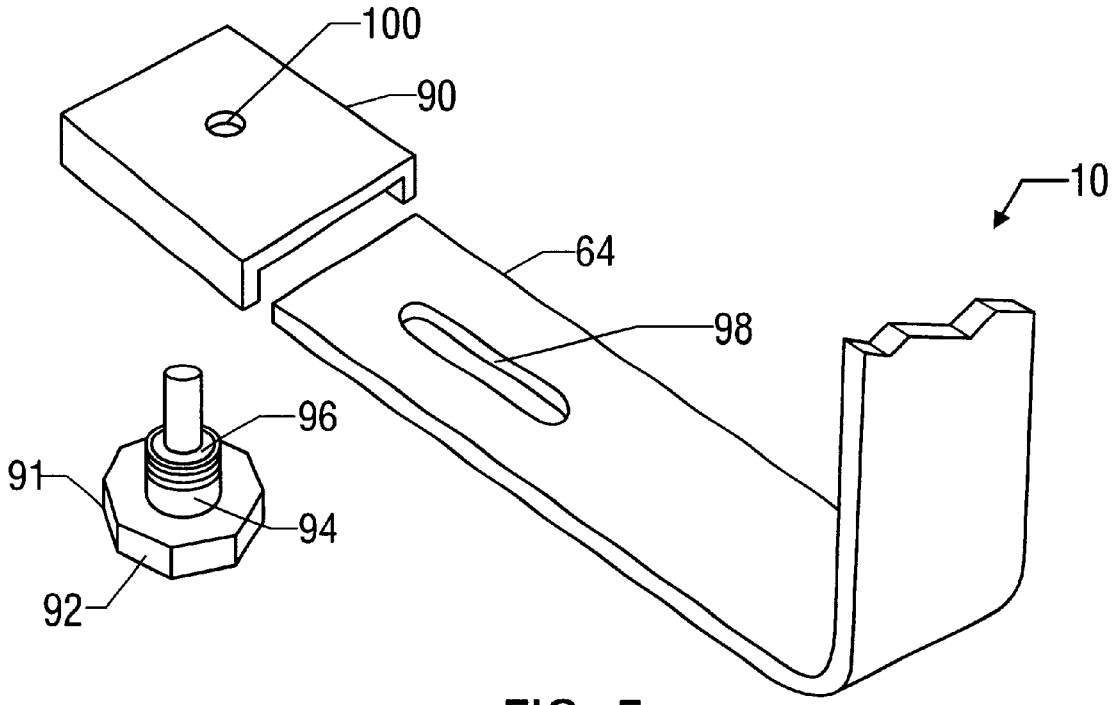
FIG. 5 is an exploded view showing the width adjustment assembly.

With reference to FIG. 5, the width adjustment mechanism is disclosed. Specifically, the armrest 10 is connected to a suitable chair or seat bracket by means of an arm bracket 90. In use, the arm bracket is mounted to the underside of a suitable seat in a manner well known by those of ordinary skill in the art. For example, the arm bracket 90 may be welded or otherwise connected to any suitable mechanism on the chair to provide width adjustability of the armrest 10. The first end 64 of the L-shaped arm 60 slides into the arm bracket 90. A handwheel assembly 91, including a handwheel 92, lock washer 94, and flat washer 96, selectively locks the first end 64 of the L-shaped arm 60 to the arm bracket 90. The handwheel assembly is fitted into a horizontal slot 98 on the first end 64 of the L-shaped arm 60 and threading into the arm bracket threaded hole 100. When an individual wishes to lock the armrest in position, he or she simply tightens the handwheel assembly 91 to engage the first end 64 of the L-shaped arm 60. Movement of the L-shaped arm 60 is achieved by untightening the handwheel assembly 91. The width of the first end 64 of the L-shaped arm 60 is adjustable along the length of the horizontal slot 98 through which the handwheel assembly 91 is connected to arm bracket 90.

In use, the armrest may be adjusted in at least three separate ways. In order to adjust the overall width of the armrest relative to the seat, the user simply loosens the handwheel assembly. This allows the first end of the L-shaped arm to slide horizontally inwardly or outwardly, limited only by the length of the horizontal slot. When a desired armrest position is achieved, the handwheel assembly is tightened to secure the armrest in place. The height of the armrest may be adjusted to a selected one of ten different positions defined by the notches in the second end of the L-shaped arm. While we disclose ten positions for the linear length of the support arm, the L-shaped arm may be provided with more, or less, notches without departing from the spirit of the present invention. In the locked position, the projection of the latch member engages one of the notches, preventing vertical movement of the sleeve relative to the second end of the L-shaped arm. When a vertical adjustment is made, the second end of the latch member is pressed inwardly against the bias of the spring, thereby, rotating the projection away from the notch and permitting relative movement between the sleeve and the second end of the L-shaped arm. When a selected height is reached, the latch member is released allowing the projection to engage a notch at the selected height and, thereby, locking the armrest at a selected height.

Angular rotational adjustment of the armrest is achieved by gently lifting the arm pad and rotating the assembly in either direction. Specifically, the arm pad may be lifted under the control provided by the coupling assembly. When the arm pad is lifted, the first and second locking members are disengaged and the arm pad is free to rotate relative to the support arm. Once the user has located a desired rotational position, the arm pad is released, permitting the first and second locking members to engage each other and lock the arm pad relative to the support arm.

The armrest may be operated from a seated, standing or kneeling position. The armrest height and rotation operations are performed effortlessly from the seated position. The armrest width adjustment is normally set for a particular individual and remains in the locked position, however, the armrest height and rotation are often adjusted to accommodate a specific task and/or body position.

With the exception of the L-shaped arm, the armrest is constructed from lightweight materials, for example, plastics. This reduces the effort needed by an individual wishing to adjust the armrest. However, the armrest could be manufactured from a wide variety of materials without departing from the spirit of the present invention.

While the preferred embodiment has been shown and described, it will be understood that there is no intent to limit the invention by such disclosure, but rather, is intended to cover all modifications and alternate constructions falling within the spirit and scope of the invention as defined in the appended claims.

What is claimed is:

1. A multi-position armrest designed for use with a conventional chair to provide enhanced adjustability comprising:

a support arm having a first end adapted for attachment to a chair and a second end coupled to an arm pad, the arm pad including a first circular locking member engaging a second circular locking member on the support arm, said first circular locking member having a frustoconical configuration with channels equally spaced around the entire circumference and said second circular locking member having a complimentary frustoconical aperture such that said first and second locking members mesh to selectively lock the arm pad relative to the support arm;

said first and second circular locking members connected by coupling means whereby said coupling means permits the first circular locking member to rotate 360 degrees relative to the second circular locking member.

2. The armrest according to claim 1, further including means for adjusting the linear length of the support arm.

3. The armrest according to claim 2, further including means for adjusting the lateral position of the support arm with respect to the seat to vary the width of the chair.

4. The armrest according to claim 1, further including means for adjusting the lateral position of the support arm with respect to the seat to vary the width of the chair.

5. The armrest according to claim 1, wherein the first circular locking member is an outwardly projecting member and the second circular locking member is a concave member shaped to receive the first circular locking member.

6. The armrest according to claim 5, wherein the first circular member includes a first set of teeth and the second circular locking member includes a second set of teeth shaped to receive the first set of teeth to lock the arm pad in position relative to the support arm.

7. The armrest according to claim 6 wherein the teeth of said first set of teeth and said second set of teeth are substantially square-shaped.

8. The armrest according to claim 1, wherein the first circular member includes a first set of teeth and the second circular locking member includes a second set of teeth shaped to receive the first set of teeth to lock the arm pad in position relative to the support arm.

9. The armrest according to claim 8, wherein the teeth of said first set of teeth and said second set of teeth are substantially square-shaped.

10. A multi-position armrest designed for use with a conventional chair to enhance the comfort of an individual seated within the chair, comprising:

a support arm having a first end adapted for attachment to a chair and a second end coupled to an arm pad, the arm pad including a first circular locking member engaging a second circular locking member on the support arm, said first circular locking member having a frustoconical configuration with channels equally spaced around the entire circumference and said second circular locking member having a complimentary frustoconical aperture such that said first and second locking members mesh to selectively lock the arm pad relative to the support arm;

said first and second circular locking members connected by coupling means whereby said coupling means permits the first circular locking member to rotate 360 degrees relative to the second circular locking member.

11. The armrest according to claim 10, further including means for adjusting the linear length of the support arm.

12. The armrest according to claim 11, further including means for adjusting the lateral position of the support arm with respect to the seat to vary the width of the chair.

13. The armrest according to claim 10, further including means for adjusting the lateral position of the support arm with respect to the seat to vary the width of the chair.

14. The armrest according to claim 10, wherein the first circular locking member is an outwardly projecting member and the second circular locking member is a concave member shaped to receive the first circular locking member.

15. The armrest according to claim 14, wherein the first circular member includes a first set of teeth and the second circular locking member includes a second set of teeth shaped to receive the first set of teeth to lock the arm pad in position relative to the support arm.

16. The armrest according to claim 15, wherein the teeth of said first set of teeth and said second set of teeth are substantially square-shaped.

17. The armrest according to claim 10, wherein the first circular member includes a first set of teeth and the second circular locking member includes a second set of teeth shaped to receive the first set of teeth to lock the arm pad in position relative to the support arm.

18. The armrest according to claim 17, wherein the teeth of said first set of teeth and said second set of teeth are substantially square-shaped.

19. A multi-position armrest designed for use with a conventional chair to enhance the comfort of an individual seated within the chair, comprising:

a support arm having a first end adapted for attachment to a chair and a second end coupled to an arm pad, the arm pad including a first circular locking member engaging a second circular locking member on the support arm, said first circular locking member having a frustoconical configuration with channels equally spaced around the entire circumference and said second circular locking member having a complimentary frustoconical aperture such that said first and second locking members mesh to selectively lock the arm pad relative to the support arm;

said first and second circular locking members connected by coupling means whereby said coupling means permits the first circular locking member to rotate 360 degrees relative to the second circular locking member;

means for adjusting the linear length of the support arm; and means for adjusting the lateral position of the support arm with respect to the seat to vary the width of the chair.

20. A multi-position armrest designed for use with a conventional chair to enhance the comfort of an individual seated within the chair, comprising:

a support arm having a first end adapted for attachment to a chair and a second end coupled to an arm pad, the arm pad including a first circular locking member engaging a second circular locking member on the support arm in a manner permitting the arm pad to selectively rotate 360 degrees relative to the support arm, said first circular locking member having a frustoconical configuration with channels equally spaced around the entire circumference and said second circular locking member having a complimentary frustoconical aperture such that said first and second locking members mesh to selectively lock the arm pad relative to the support arm;

said arm pad includes a longitudinal support member having a cushioning member secured on the upper surface of said longitudinal support member.

21. The armrest according to claim 20, further including means for adjusting the linear length of the support arm.

22. The armrest according to claim 20, further including means for adjusting the lateral position of the support arm with respect to the seat to vary the width of the chair.

23. A multi-position armrest designed for use with a conventional chair to provide enhanced adjustability comprising:

a support arm having a first end adapted for attachment to a chair and a second end coupled to an arm pad, the support arm including a first circular locking member engaging a second circular locking member on the arm pad, said first circular locking member having a frustoconical configuration with channels equally spaced around the entire circumference and said second circular locking member having a complimentary frustoconical aperture such that said first and second locking members mesh to selectively lock the arm pad relative to the support arm;

said first and second circular locking members connected by coupling means whereby said coupling means permits the first circular locking member to rotate 360 degrees relative to the second circular locking member.

24. A multi-position armrest designed for use with a conventional chair to enhance the comfort of an individual seated within the chair, comprising:

a support arm having a first end adapted for attachment to a chair and a second end coupled to an arm pad, the support arm including a first circular locking member engaging a second circular locking member on the arm pad, said first circular locking member having a frustoconical configuration with channels equally spaced around the entire circumference and said second circular locking member having a complimentary frustoconical aperture such that said first and second locking members mesh to selectively lock the arm pad relative to the support arm;

said first and second circular locking members connected by coupling means whereby said coupling means permits the first circular locking member to rotate 360 degrees relative to the second circular locking member.

* * * * *